US005190486A

United States Patent [19]

Tsuk

[11] Patent Number: 5,190,486

[45] Date of Patent: Mar. 2, 1993

[54] SELECTIVELY PLATING ELECTRICALLY CONDUCTIVE PIN

[75] Inventor: Peter Tsuk, Westmount, Canada

[73] Assignee: Northern Telecom Limited, Montreal, Canada

[21] Appl. No.: 734,714

[22] Filed: Jul. 23, 1991

[51] Int. Cl.[5] ..... B05D 3/06

[52] U.S. Cl. ..... 439/886; 205/133; 427/125; 427/265; 427/282

[58] Field of Search ..... 439/886, 887; 29/885; 427/123, 125, 258, 259, 256, 265, 272, 282, 284; 205/133, 252, 253, 254, 266, 118, 123, 125

[56] References Cited

U.S. PATENT DOCUMENTS

| | | | |
|---|---|---|---|
| 3,749,649 | 7/1973 | Valayil | 205/253 |
| 4,087,906 | 5/1978 | Cobaugh et al. | 29/885 |
| 4,103,416 | 8/1978 | Sakamoto | 439/887 |
| 4,236,976 | 12/1980 | Kohl | 205/133 |
| 4,274,699 | 6/1981 | Keim | 439/637 |
| 4,722,470 | 2/1988 | Johary | 427/282 |
| 4,883,774 | 11/1989 | Djennas | 427/98 |
| 5,032,421 | 7/1991 | Sarma et al. | 427/125 |

*Primary Examiner*—Neil Abrams
*Attorney, Agent, or Firm*—R. J. Austin; A. de Wilton

[57] ABSTRACT

An electrically conductive pin and a method of selectively plating an electrically conductive pin. The pin provides gold plated contact regions on two end portions and a center portion plated with another conductive material, which may be tin lead. The method includes selectively masking desired gold plated contact regions with a plating resist material and then plating the center portion with the other conductive material. The plating resist material is preferably an insulator deposited by electrophoresis. The plating resist material is removed, after plating the center portion with the other conductive material, to expose the gold plated contact regions.

26 Claims, 4 Drawing Sheets

SELECTIVELY PLATING ELECTRICALLY CONDUCTIVE PIN

Figure 1:
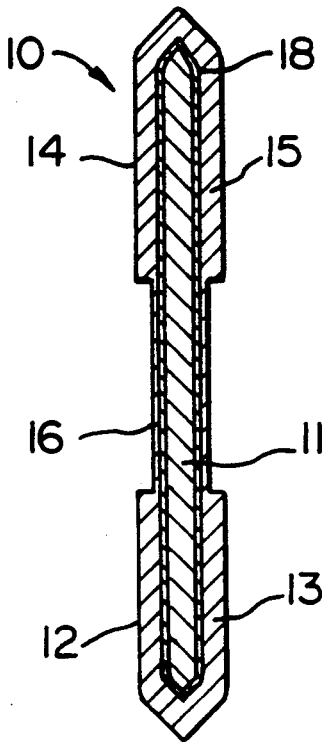
FIG. 1 PRIOR ART

This invention relates to selectively plated electrically conductive pins and a selective plating process for electrically conductive pins.

Conventionally, electrically conductive pins for connectors and circuit boards providing gold contacts at both ends have contact regions plated with contact gold, 30–100 micro inches thick, to provide good electrical contact properties. A center portion of the pin may be plated with a thinner gold flash (3–10 micro inches), to provide protection from corrosion and, in the case of a non-compliant pin, to render the surface solderable.

Conventionally, the differential thickness of gold plating on the end contact regions and on the center portion of the pins is provided by electroplating from gold plating solution in a controlled depth plating cell.

The center portion of the pin is generally in contact with a printed circuit board with which it forms a gas tight seal and which prevents deterioration. Therefore, the central portion of the pin does not require the special properties of a gold plating and a plating of another, less expensive metal or alloy, such as tin-lead, would be satisfactory. If pins are carried on a bandolier during plating, gold which is incidentally deposited on the bandolier during plating of the center portion of pins is wasted unless the bandolier is processed after use to reclaim the gold.

The present invention seeks to provide selectively plated electrically conductive pins and a method for o selectively plating electrically conductive pins, which avoids the above mentioned problems and allows the use of less gold.

Thus according to one aspect of the present invention there is provided a method of selectively plating an electrically conductive pin having a center portion between two end portions, the method comprising: plating only end portions with gold to form gold plated contact regions and the center portion with another conductive material.

Thus, the center portion of the pin is devoid of gold and a plating of another conductive material is used instead of gold on the center portion of the pin. The method according to this aspect of the invention therefore allows less gold to be used to provide a pin with a conductive plating on end and center portions of the pin.

According to another aspect of the present invention there is provided a method of selectively plating surfaces of an electrically conductive pin having gold plated contact regions, the method comprising: selectively masking desired gold plated contact regions with a plating resist material; plating unmasked pin surfaces with another conductive material; and removing the resist material, whereby the desired gold plated contact regions are exposed uncontaminated by the other conductive material.

In the method according to the latter aspect of the invention, masking desired gold plated contact regions protects the gold contact regions from contamination by the other conductive material during plating of the other conductive material on the unmasked pin surfaces. Also the method according to this aspect ensures that gold plating does not overlie the other conductive material.

According to another aspect of the invention there is provided a method of selectively plating an electrically conductive pin having a center portion between two end portions, the end portions having gold plated contact regions, and the method comprising: selectively masking desired gold plated contact regions with a plating resist material; plating the center portion of each pin with another conductive material; and removing the resist material, whereby plating of the other conductive material over the desired gold plated contact regions is avoided.

The step of masking desired gold plated contact regions may comprise immersing said desired gold plated contact regions of the pin in a liquid containing plating resist material to provide a coating of plating resist material. Preferably, the plating resist material is an insulator and the coating of the plating resist material is deposited from the liquid containing plating resist material by electrophoresis.

In a convenient manner of performing the method, one end portion of the pin is coated with plating resist material to mask the gold plated contact regions on the end portion, then, by controlled depth plating, electroplating the center portion of the pin with the other conductive material. The masked end portion and center portion only of the pin are immersed into a plating solution of the other conductive material during the controlled depth plating. The resist material is removed from the pin after removal of the pin from the plating solution.

In a practical and advantageous method of plating the pin, the pin is one of a series of pins carried upon a bandolier. The bandolier is moved along a passline to treat the pins in succession by selectively masking the desired gold plated contact regions and then plating the unmasked pin surface with the other conductive material.

The method steps of selectively coating pins with resist material and selectively metal plating the pins may be carried out in a series of controlled depth processing cells. Where pins are carried on a bandolier the process may comprise an in line process where a bandolier carrying pins moves along a passline from a supply reel to a take-up reel as pins pass successively through the series of controlled depth processing cells along the passline and in which they are respectively resist coated, plated and resist stripped.

Preferably the other conductive material comprises a metal alloy having a low contact resistance, which may be tin-lead. Where the electrically conductive pin is a non-compliant pin, the other metal is preferably also a solderable metal alloy. i.e. tin-lead.

According to yet another aspect of the invention there is provided a method of selectively plating pins having a center portion between two end portions, the method comprising: plating only end portions with gold to form gold plated contact regions; selectively masking desired gold plated contact regions with plating resist material; plating the center portion of the pin with another conductive material; and removing the plating resist material, whereby an overlayer of gold on said other conductive material is avoided.

According to a further aspect of the invention there is provided an electrically conductive pin comprising a center portion between two end portions, the end portions only having gold plated contact regions and the center portion being selectively plated with another conductive material.

Thus the center portion of the pin is devoid of gold and a plating of another conductive material is provided on the center portion. Therefore a minimal amount of gold is used, i.e. only on the end portions. The structure of the pin may provide for the gold to overlap the other conductive material so as that the pin is completely plated and any under-plating on the pin is not exposed.

However, according to yet another aspect of the invention there is provided an electrically conductive pin comprising a body having a center portion between two end portions, the end portions only being selectively plated with gold to provide gold plated contact regions, and the center portion being selectively plated with an other conductive material, the other conductive material contacting the center portion only of the pin body, with inwardly facing surfaces of gold on plated end portions contacting only the body of the pin, whereby an overlayer of gold on said other conductive material is avoided.

In an advantageous structure of a pin according to this other aspect invention the other conductive material may overlap the gold plating, but the gold plating does not overlap the other conductive material. This avoids a pin structure in which the gold plating overlaps the other conductive material. Such a structure could have problems when the other conductive material is for example tin-lead, which is softer than gold and does not provide a good base for gold plating so that regions of gold overlying tin lead may suffer wear in use and collapse. Preferably, the other conductive material contacts gold plated contact regions only at parts of the gold plated contact regions adjacent the center portion of the pin, so that the gold plated contact regions are not contaminated by the other conductive material, which may lead to an increase in contact resistance of the gold plated contact regions.

Thus, the present invention provides a selectively plated electrically conductive pin and a method of selectively plating an electrically conductive pin having end portions providing gold contact regions and center portion plated with another conductive material so as to reduce the amount of gold used for plating and to avoid the above mentioned problems.

Figure 2:
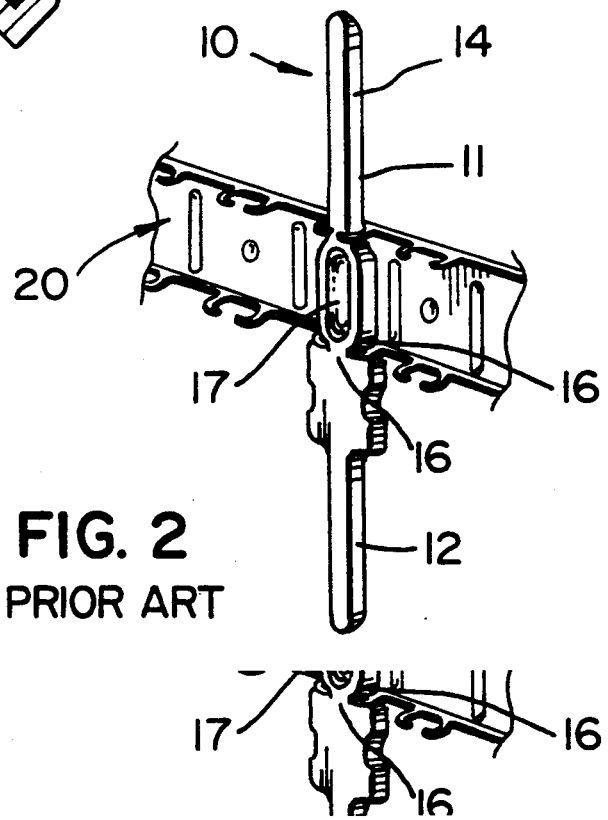
FIG. 2 PRIOR ART
Figures 3A, 3B, 3C:
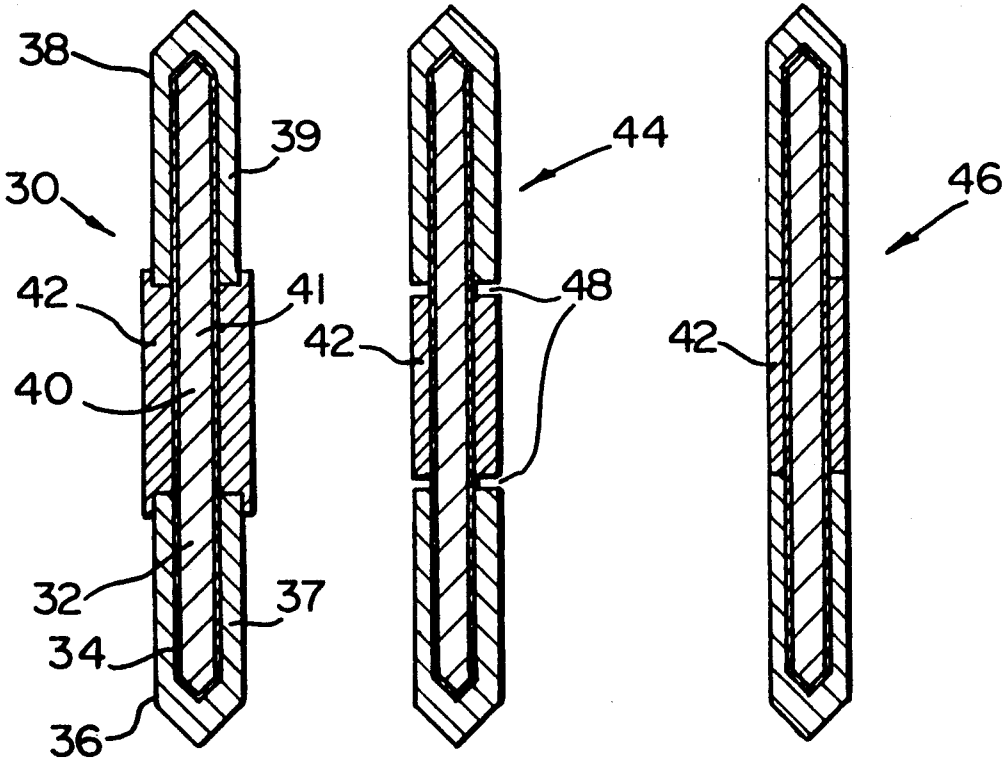
Figure 4:
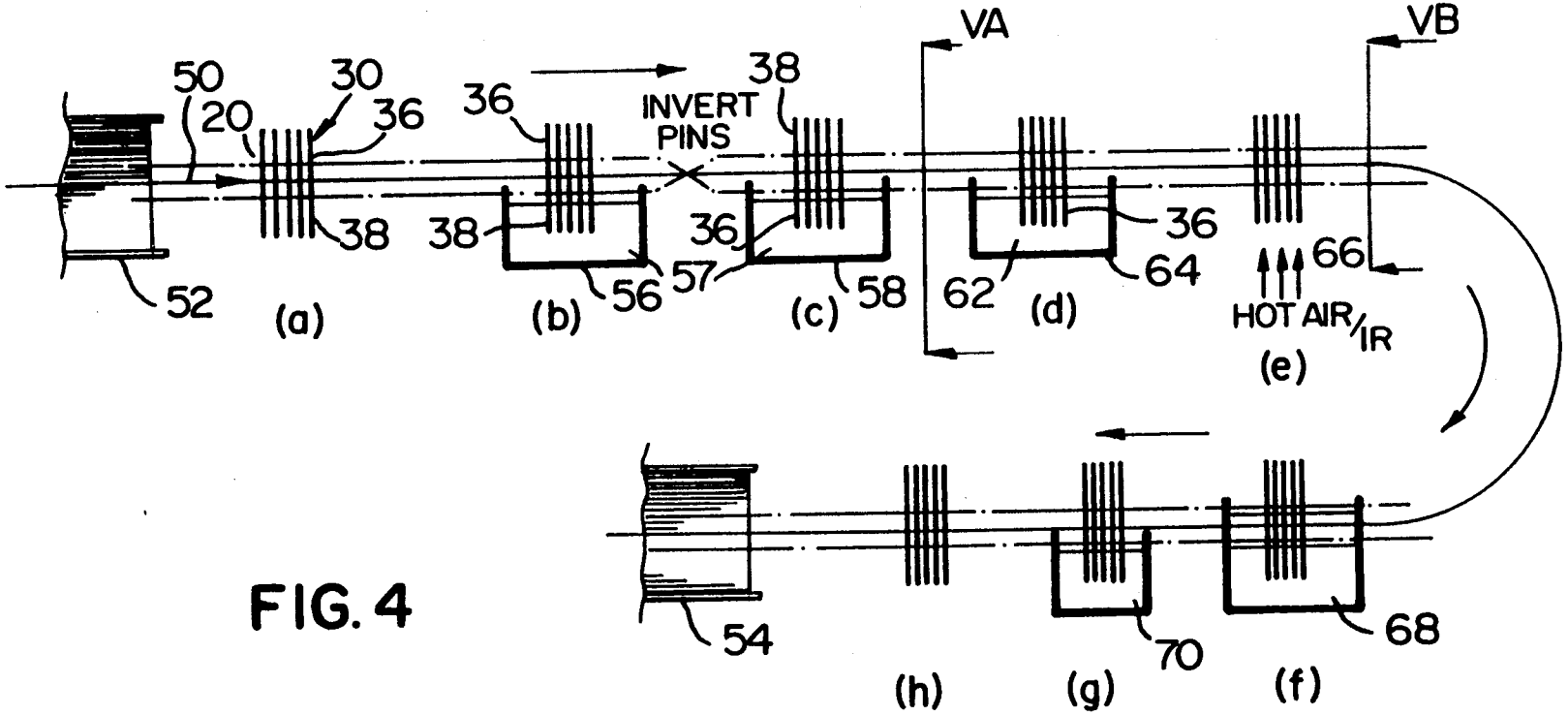
Figures 5A, 5B, 5C:
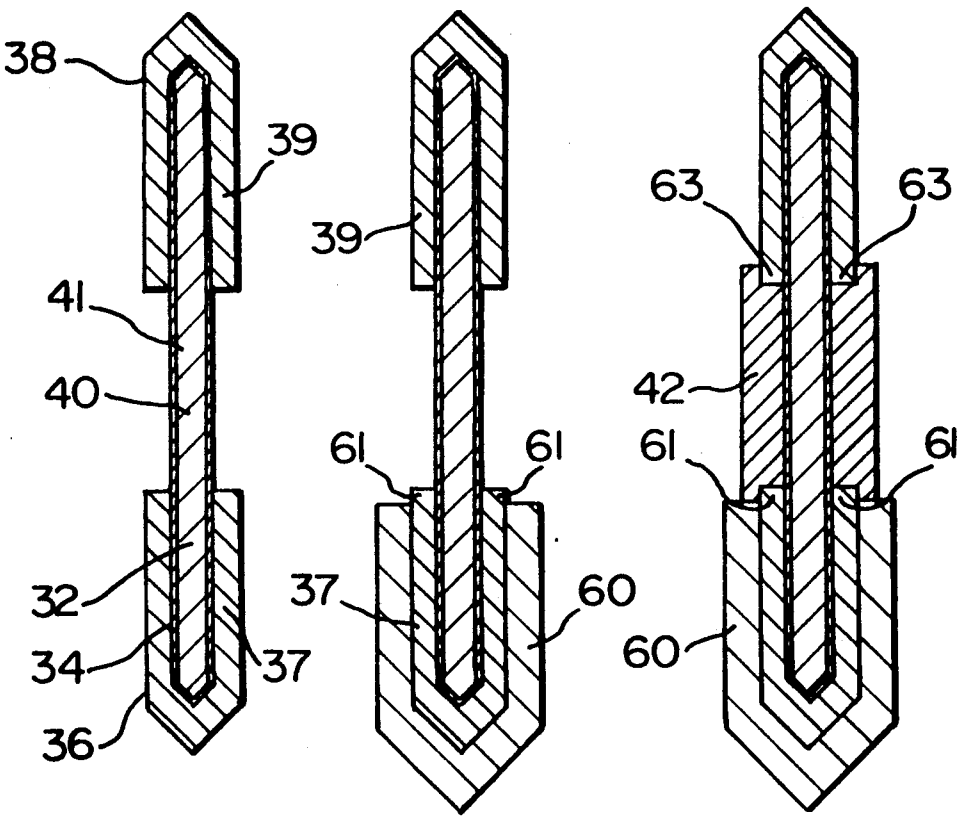

An embodiment of the invention will now be described by way of example, with reference to the accompanying drawings, in which FIG. 1 is a cross-sectional view along the length of a electrically conductive pin of prior art structure;

FIG. 2 is a perspective view of the prior art conductive pin of FIG. 1 carried on a bandolier of prior art structure;

FIG. 3*a* is a cross-sectional view of a selectively plated electrically conductive pin according to an embodiment of the present invention and FIGS. 3*b* and 3*c* are modifications of the pin of the embodiment of the invention;

FIG. 4 is a schematic diagram of an apparatus for in-line controlled depth plating of pins according to the embodiment; and FIG. 5*a*, 5*b* and 5*c* are cross-sectional views through pins at different stages in use of the process upon the apparatus of FIG. 4.

A prior art electrically conductive pin in the form of a printed circuit board pin 10 is of conventional structure for use with connectors and printed circuit boards, as shown in FIG. 1, and comprises a integral body 11 of rectangular cross section, having a phosphor bronze base which is supplied pre-plated on two or four faces with a nickel under-plating 18. End portions 12 and 14 of the pin body are selectively plated with gold to form gold plated contact regions 13 and 15. The end portions 12, 14 of the pins are of rectangular cross section. The gold plating on contact regions 13, 15 of the end portions 12,14 may be typically 30–100 micro inches in thickness and formed by selective electroplating of each end portion 12, 14 of the pin 10. A thinner plating of 3–10 micro inches of gold plate (gold "flash") is provided on a center portion 16 of the pin body 11. The center portion 16 of the pin body is formed with a compliant section 17 for engagement with a hole in a circuit board so as to form a contact. The pin 10 is one of a plurality of substantially identical pins carried by a bandolier 20 as shown in FIG. 2, with end portions 12, 14 of the pins extending each side of the bandolier. The bandoliered pins are supplied on a reel (not shown) to enable reel-to-reel processing of pins by a continuous in-line process. The contact gold on the end portions 12,14 and the gold flash on the center portion 16 of a pin may be provided by electroplating in conventional controlled depth plating cells by immersing the center portion and/or the end portions of the pin body to a desired depth in gold plating solution. During plating of the center portion 16 of a pin carried on a bandolier 20, the bandolier incidentally receives a gold plating. To prevent waste of gold, gold may later be reclaimed from the bandolier.

A pin 30 according to an embodiment of the present invention is shown in FIG. 3*a*. The pin is similar to that shown in FIG. 1 in comprising a integral body 32 having a phosphor bronze base and including a nickel plating 34. End portions 36 and 38 of the pin body 32 are selectively plated with gold to a thickness of between 30 and 100 micro inches (i.e. 0.8 to 2.5 $\mu$m) to form gold plated contact regions 37,39. The pin 30 differs from the prior art pin 10 because a center portion 40, (the portion including the compliant section 41) is selectively plated with another conductive material, i.e. tin-lead alloy plating 42, and is devoid of gold. The tin-lead alloy plating 42 on the center portion 40 just overlaps the adjacent parts of the gold plated contact regions 37,39 of the end portions 36 and 38, so that none of the nickel plated layer 34 of the body 32 of the pin is exposed. Thus all inwardly facing surfaces of the gold plated regions 37, 39 contact only the end portions 36 and 38 of the pin body, that is, in this case, the nickel plating 34 on the pin body 32. The gold plating does not overlap the tin-lead plated center portion 40 of the pin body.

In use of the pin, the tin-lead plating 42 on the center portion 40 provides an electrically conductive plating having a low contact resistance between the compliant section 41 of the center portion 40 of the pin and a pin receiving contact hole of a circuit board or connector. The tin-lead plated center portion 42 also provides a solderable surface where a soldered connection is required. The center portion 40 is devoid of gold so that a selectively plated pin according to the embodiment requires use of less gold, while the plating of the other conductive material on the center portion of the pin provides desired electrical contact properties. This structure of the embodiment has a further advantage in that the pin avoids problems encountered when gold overlaps a softer material, such as tin lead, which does not provide a good base for gold plating and which, during use, tends to collapse.

In modifications of the embodiment, now to be described, the same reference numerals are used for features identical with or similar to those of the embodiment.

In one modification of the pin of the embodiment, shown in FIG. 3*b*, a pin 44 has the tin lead plating 42 on the center portion 40 just spaced apart from the parts of the gold plated contact regions 37,39 adjacent the center portion 40, leaving a slight gap with portions 48 of the nickel plated layer 34 of the body exposed. This structure may be used in applications where corrosion of exposed portions 48 in the gap between the gold and tin lead platings is not a concern.

In applications where it is desirable that the pin is completely plated so that the underplating of the body of the pin, i.e. the nickel plating, is not exposed to corrosion, a pin 46 which is another modification of the pin of the embodiment, and as shown in FIG. 3*c*, provides tin lead alloy plating on the center portion which abuts but does not overlap the gold plated contact regions 37, 39 on the end portions of the pin body.

In both of the above modifications, the whole of the gold plated contact regions 37,39 are exposed and the other conductive material, (i.e. the tin lead alloy) 42 does not overlap the gold plated contact regions 37,39.

In a method of forming a plurality of finished pins 30 of the embodiment, the pins 30 are carried on a bandolier 20, similarly as shown for prior art pins 10 in FIG. 2, with the center portion 40 of each pin held by the bandolier 20 and with the end portions 36,38 of the pins extending each side of the bandolier. The plating process is carried out conveniently as an in-line process for which the bandoliered pins 30 are supplied on a supply reel 52 and the bandolier moved along a passline 50 from the supply reel to a take-up reel 54 so that the pins are successively processed through a sequence of process steps as described below (FIG. 4*a*). The pins 30 have a rectangular cross section, as shown in FIG. 2, and they are supplied pre-plated on two or four faces with an under-plating 34 of nickel. As each pin is fed by the bandolier 20 along the passline 50, the four faces of the end portions 36 and 38 are selectively electroplated with gold by a conventional plating method in two controlled depth plating cells 56, 58 where each end portion 36,38 respectively is immersed to the required depth in a gold plating solution 57 and plated with a desired thickness of contact gold to form the gold plated contact regions 37,39 on end portions 36,38 of the pins (FIG. 4*b*). To plate both end portions of each pin, the bandolier is inverted in its passage between the plating cells 56 and 58 (FIG. 4*b* and 4*c*). The contact regions 37 and 39 are plated to their required 30–100 micro inches in thickness to provide the desired contact characteristics. The gold plated pin then appears, in section, as shown in FIG. 5*a*. Hence the center portion 40 of each of the pins and the bandolier is not gold plated, and after gold plating of the end contact regions of the pins, the nickel plating 34 of each pin body 32 remains exposed on the center portion 40 of the pin body.

One end portion 36 of each pin 30 is then coated with a plating resist material 60 (FIG. 5*b*) to mask desired gold plated regions, which, in this case, is the whole of the gold plated contact region 38 on the one end portion 36 of the pin except for a narrow band of gold 61 adjacent to the center portion of the pin (FIG. 5*b*). The plating resist material is preferably an insulator, such as an acrylic resin based material, suitable for deposition by electrophoresis, for example, Selrex Electroclear 2000®, manufactured by Enthone OMI Canada Ltd.

The coating of plating resist material on end portions of the pins is deposited by electrophoresis during immersion of end portions of the pins in a liquid 62 containing the plating resist material 60 and contained in a cell 64 (FIG. 4*d*).

The liquid 62 is an aqueous suspension of colloidal particles of the resist material. The electrophoresis method allows a resist coating of an insulating material to be controllably and uniformly deposited over pin surfaces to a desired thickness of approximately 1 thousandth of an inch in a process analogous to electroplating. The pins are coated by immersion in liquid containing the plating resist material to the required depth to form a masking layer of resist over the desired gold plated contact regions. The process may be carried out using a known controlled depth processing cell 64, similar to those used for electroplating of gold, holding the liquid 62 containing the plating resist material. Thus the extent of masking of desired gold plated contact regions is controlled by controlling the depth of immersion of end portions of pins into the liquid containing plating resist and a layer of resist material is deposited to the desired thickness by electrophoresis.

After the pins leave the cell 64, the plating resist material is dried and partially cured by a conventional method comprising exposure to infrared radiant heat, or to hot air indicated at 66 in FIG. 4*e*. The resist material is preferably cured by air drying at 140° F. for 1 minute. This results in an uncured or partially cured material which has sufficient resistance to be unaffected by subsequent acid cleaning and plating operations and to prevent contamination of these solutions, but lack of complete curing facilitates subsequent removal of the material from the pins without trace of residual contamination. This rapid curing process is in contrast to the usual curing process used with Selrex Electroclear 2000®, for its conventional use for tarnish protection of jewellery, where the resin coating is cured at 311° F. for 20 minutes. The latter process is unsuitable for the present application.

After masking of desired gold plated regions of one end portion of each pin, the pins are then selectively plated with the conductive material, i.e. a tin-lead alloy, to provide the plating 42 (FIG. 5*c*). This is performed in another conventional controlled depth plating cell 68 (FIG. 4*f*), one resist coated end portion 36 and center portion 40 of each pin being immersed into the tin-lead plating solution so that the exposed nickel plated region and any unmasked gold plated contact region of this one end of the pin is electro-plated with tin-lead (FIG. 3*c*). The bandolier is incidentally lead-tin plated too. The pins are preferably immersed to a sufficient depth that the tin lead plating 42 just overlaps the adjacent end 63 of the gold plated contact region 39 at the other end portion 38 as shown in FIG. 3*a* and 5*c*.

The plating resist material is then removed from the pins by immersion of resist coated ends of the pins into a hot alkali stripping solution, containing for example potassium hydroxide and other water soluble solvents such as butyl- and hexa-cellusolves, with agitation, in another conventional reel-to-reel controlled depth processing cell 70. The preferred stripping solution is Cathoclear Stripper 200® manufactured by Enthone OMI Canada Ltd. Because the Electroclear 2000® resin used as resist material on the pins is not fully cured, the removal of the resist material can be completed by two 10 second dips, with vigorous agitation at 140° F. Cathoclear Stripper 200® is the material normally used to clean plating racks of cured Selrex Electroclear 2000® resin prior to re-use, by immersion for several hours at 140° F., but such an extended processing time is clearly impractical for an in-line stripping process.

Gold, nickel and tin-lead plating are resistant to immersion in the hot alkali stripping solution. It is important in this application that traces of the masking resin are removed from the gold surfaces. The selected materials can accomplish this removal effectively by a cascade arrangement of two or more stripping tanks. The last stripping tank is the cleanest, supplying solution to the first stripping tank which is then discarded after it becomes too heavily loaded with resin.

Thus the desired gold plated contact regions are masked by plating resist material during the tin-lead plating process to prevent contamination of the gold plate with tin-lead which may cause unacceptable increases in contact resistance, i.e. 0.2 mΩ or more. The pin is selectively plated with gold on the end portions and tin-lead on the center portion.

In the above described method, the tin lead overlaps the parts of the gold plated contact regions adjacent the center portion of the pin to provide the structure shown in FIG. 3*a*. This has the advantage that the pin is completely plated, but the gold does not overlap the relatively soft tin lead. The nickel underplating is completely covered to avoid exposure of nickel which may result in corrosion and blackening, which, apart from being visually unacceptable, may in use result in poor electrical contact. Also, nickel may have a high contact resistance with other metals at contact holes in circuit boards. Further, by using the in-line process described, not only is gold not used on the center portion 40 of each pin, but also it is not used to plate the bandolier. Hence gold is only applied in the locations where it is basically required, i.e. at the end regions, 36 and 38.

In the manufacture of the modified pin (FIG. 3*c*), in order to obtain a continuous plating, gold plated contact regions on one end portion of each pins are completely coated with resist material 50 without the resist material extending onto the center portions 40 of the pins. During plating of the tin-lead by the method described for the embodiment, one end portion and the center portion of the pin is immersed so that the tin-lead plating extends only over the center portion of the pin, so as to cover only the exposed nickel plated region of the center portion of the pin, but the pin is not immersed sufficiently for the tin lead to overlap gold plated contact regions at the other end portion of the pin. Thus the pin is completely plated with gold on end portions and tin lead over the center portion with the gold abutting the tin lead, but not underlying or overlying it. Ideally the depth of immersion of the end portions of the pins into the plating resist material may be controlled so as to mask the gold plated contact regions completely or partially. However, this ideal situation is very difficult to control.

The other modified pin 44, (FIG. 3*b*) is more practical to achieve wherein the resist material 50 is caused to extend completely over the gold plated region 37 and slightly onto the center portion 40 of the pin. The tin lead alloy plating does not extend onto the resist material which, upon removal results in one portion 44 of nickel being exposed. The other portion 44 is formed by holding the gold plated region 39 spaced slightly above the liquid 62 containing plating resist material 60 in cell 64 (FIG. 4*d*).

Thus, by selectively masking desired portions of the pin, i.e. the whole or part of the gold plated contact regions with plating resist material, pins having different regions selectively plated with one or more metals may be produced, with or without overlap between the different metals.

In a modification of the process of the embodiment, pins may be provided with gold plating on only two of four faces of end portions of the pins by gold plating in a mechanical masking type plating cell.

In an alternative method of providing any of the pins of FIGS. 3*a*, 3*b* and 3*c*, desired gold plated contact regions of both end portions of a pin are masked with resist and the center portion of the pin is plated with another conductive material. This method provides the advantage that resist coating on the other end portion of the pin ensures that gold plated contact regions at both ends of the pins are protected from contamination by the other conductive material. For example, accidental immersion of ends of pins to a greater depth than desired may result in excessive overlap of the other conductive material on desired gold plated contact regions which may be avoided by resist coating both end portions of the pin.

Electrophoresis coating with Electroclear 2000® material provides a continuous and uniform coating in contrast to conventional plating resist materials and methods, which were found to be unsuitable for the present application. Furthermore, electrophoresis provides rapid deposition of resist material with immersion times of less than 1 minute per pin which is acceptable for an in-line process. However, the curing and stripping processes used in the present application are completely different from the conventional use of electrophoretically deposited Electroclear 2000® material which required extended times for curing and stripping processes. The latter processes are therefore unsuitable for rapid in-line processing. In the present application, a completely different process results in a partially cured resist material which may be easily and rapidly stripped, by immersion of the pin in a stripping solution for only 10 to 20 seconds, without leaving residue or contaminants on gold plated contact regions, thus resulting in higher yield of pins with desired electrical contact properties. Further, the use of an aqueous system avoids problems with environmental contamination, flammability and disposal of conventional plating resist materials, such as solvent based solutions of varnishes or wax, and reduces the use of stripping solutions of organic solvents, including chlorinated solvents.

What is claimed is:

1. A method of selectively plating a series of electrically conductive pins carried on a bandolier, each pin having a center portion between two end portions, and end portions only of each pin having gold plated contact regions, the method comprising:

moving the bandolier along a passline and sequentially processing pins as the series of pins move on the bandolier along the passline, by steps including:

selectively masking desired gold plated contact regions with a coating of a plating resist material, plating with another conductive material the center portion of each resist coated pin and then removing plating resist material from pins, whereby plating of the other conductive material over the desired gold plated contact regions is avoided.

2. A method according to claim 1 wherein selectively masking desired gold plated contact regions comprises successively coating one end portion of each pin with plating resist material and, plating with another conductive material the center portion of each resist coated pin comprises controlled depth plating with immersion of said resist coated one end portion and center portion of the pin into a plating solution of said conductive material.

3. A method according to claim 2 wherein the step of plating with another conductive material comprises plating of the bandolier with the other conductive material.

4. A method of selectively plating a series of electrically conductive pins carried on a bandolier, each pin having a center portion between two end portions, the method comprising:

moving the bandolier along a passline and sequentially processing pins as the series of pins move on the bandolier along the passline, by steps including;

plating only end portions of the pins with gold to form gold plated contact regions;

selectively masking desired gold plated contact regions with a coating of plating resist material, plating the center portion of each resist coated pin with another conductive material; and then moving plating resist material from each pin, whereby plating of the other conductive material over the desired gold plated contact regions is avoided.

5. A method according to claim 4 wherein the step of selectively masking desired gold plated contact regions comprises successively immersing said desired gold plated contact regions of the pin in a liquid containing plating resist material to provide the coating of plating resist material on desired gold plated contact regions.

6. A method according to claim 5 wherein the plating resist material is an insulator and the coating of plating resist material is deposited from the liquid containing plating resist material by electrophoresis.

7. A method according to claim 6 wherein the coating of plating resist material is deposited during immersion of the pin to a desired depth in the liquid containing plating resist material in a controlled depth plating cell.

8. A method according to claim 4 wherein plating with the other conductive material comprises plating with a tin lead alloy.

9. A method according to claim 1 or claim 4 wherein desired gold plated contact regions comprise a part of a gold plated contact region of one end portion of a pin, and the step of selectively masking said desired gold plated contact regions comprises immersing the one end portion in a liquid containing plating resist material to a sufficient depth to provide a coating of plating resist material on said part of the gold plated contact region.

10. An electrically conductive pin comprising:

an integral body having a center portion between two end portions, and the end portions only being selectively plated with a gold to provide gold plated contact regions thereon, and the center portion of the pin being selectively plated overall with a uniform thickness of an other conductive material, the other conductive material contacting the center portion only of the body and extending between gold plated contact regions of the two end portions without underlying said gold plated contact regions, with inwardly facing surfaces of gold contacting only the body of the pin, whereby an overlayer of gold on said other conductive material is avoided.

11. An electrically conductive pin according to claim 10 wherein the whole of the center portion is selectively plated with the other conductive material, and the other conductive material contacts gold plated end portions only at parts of the gold plated contact regions adjacent the center portion.

12. A pin according to either of claims 10 or 11 wherein the other conductive material abuts parts of the gold plated end portions adjacent the center portion of the pin.

13. A pin according to either of claims 10 and 11 wherein the other conductive material overlaps parts of the gold plated end portions adjacent the center portion of the pin.

14. A pin according to either of claims 10 and 11 wherein the other conductive material comprises a tin-lead alloy.

15. A method of selectively plating an electrically conductive pin having a center portion between two end portions, the end portions having gold plated contact regions, and the method comprising:

selectively masking desired gold plated contact regions by coating one end portion of the pin with plating resist material;

plating the center portion of the pin with another conductive material by controlled depth plating with immersion of said resist coated one end portion and center portion of the pin into a plating solution of said conductive material;

then after removal from the plating solution removing the plating resist material from the pin, whereby plating of the other conductive material over the desired gold plated contact regions is avoided.

16. A method according to claim 15 wherein the plating resist is an insulating material and the step of coating said one end portion of the pin with plating resist material comprises immersing said one end portion of the pin in a liquid containing plating resist material to a desired depth in a controlled depth plating cell and depositing plating resist material on said one end portion by electrophoresis.

17. A method according to claim 16 wherein the coating of plating resist material is dried by exposure to hot air or infrared radiation before plating the pin with the other conductive material.

18. A method according to claim 16 wherein depositing the plating resist material by electrophoresis provides a uniform continuous coating of plating resist material on said one end portion of the pin, and comprising partially curing said coating of resist material before the step of plating the other conductive material.

19. A method of selectively plating an electrically conductive pin having a center portion between two end portions, the end portions having gold plated contact regions, and the method comprising:

selectively masking desired gold plated contact regions by coating at least one end portion of said two end portions with a plating resist material;

plating the center portion of the pin with a layer of a controlled thickness of an other conductive material during immersion of said resist coated at least one end portion and the center portion of the pin in a plating solution of the other conductive material;

and, after removal from the plating solution, removing the plating resist material from the pin, whereby a layer of the other conductive material is provided on the center portion between gold plated contact regions of the two end portions and plating of the other conductive material over said desired gold plated contact regions is avoided.

20. A method according to claim 19 wherein the desired gold plated contact regions comprise at least part of a gold plated contact region of one end portion of the pin, and the step of selectively masking said desired gold plated contact regions comprises immersing said one end portion of the pin in a liquid containing plating resist material to a depth sufficient to provide a coating of plating resist material on said desired gold plated contact regions.

21. A method according to claim 20 wherein the plating resist material is an insulator and the coating of plating resist material is deposited from the liquid containing plating resist material by electrophoresis.

22. A method according to claim 20 wherein the plating resist material is deposited during immersion of the pin to a desired depth in the liquid containing plating resist material in a controlled depth plating cell.

23. A method according to claim 19 wherein plating with the center portion of the pin with the other conductive material comprises electroplating with the other conductive material in a controlled depth plating cell.

24. An electrically conductive pin comprising:

an integral body having a center portion between two end portions, the pin body comprising an underplating on the end portions and center portion, ad the underplating comprising a first conductive material other than gold, and the end portions only being selectively plated with gold to provide gold plated contact regions thereon, the gold plated contact regions extending over the underplating on end portions of the pin, and the center portion of the pin being devoid of gold, and the center portion of the pin being selectively plated with a uniform thickness of an other conductive material, and the plating of the other conductive material extending around the center portion of the pin and over the underplating, thereby covering the underplating on the center portion of the pin, and the other conductive material contacting the center portion only of the body and extending between gold plated contact regions of the two end portions without underlying said gold plated contact regions.

25. A series of electrically conductive pins carried on a bandolier, each pin of the series comprising an integral body having a center portion between two end portions, the center portion of each pin being held by the bandolier with said end portions of each pin extending to opposite sides of the bandolier, the end portions only of each pin being selectively plated with gold to provide gold plated contact regions thereon, and the center portion of each pin being selectively plated with a layer of a uniform thickness of an other conductive material, and the bandolier also being plated with said other conductive material, the other conductive material contacting the center portion only of each pin body and extending around the center portion between gold plated contact regions of the two end portions without underlying said gold plated contact regions, and with inwardly facing surfaces of gold contacting only the body of the pin, whereby an overlayer of gold on said other conductive material is avoided.

26. A series of electrically conductive pins according to claim 25 wherein the other conductive material is tin lead and the bandolier and the center portion only of each pin are plated with tin lead.

* * * * *